United States Patent [19]

Higashi et al.

[11] 4,165,043

[45] Aug. 21, 1979

[54] CRUSHER APPARATUS

[75] Inventors: Kazo Higashi; Kiyohiko Sawa, both of Kobe, Japan

[73] Assignee: Kobe Steel, Ltd., Kobe, Japan

[21] Appl. No.: 862,164

[22] Filed: Dec. 19, 1977

[30] Foreign Application Priority Data

Dec. 17, 1976 [JP] Japan ..... 51-152613

[51] Int. Cl.[2] ..... B02C 18/18; B02C 18/40

[52] U.S. Cl. ..... 241/236; 83/345

[58] Field of Search ..... 241/236; 83/344, 345, 83/348

[56] References Cited

U.S. PATENT DOCUMENTS

| | | | |
|---|---|---|---|
| 3,662,964 | 5/1972 | Rossler | 241/236 X |
| 3,880,361 | 4/1975 | Schwarz | 241/236 X |

FOREIGN PATENT DOCUMENTS

| | | | |
|---|---|---|---|
| 17797 | 3/1928 | Netherlands | 241/236 |

*Primary Examiner*—Howard N. Goldberg
*Attorney, Agent, or Firm*—Oblon, Fisher, Spivak, McClelland & Maier

[57] ABSTRACT

A crusher including a series of cutter units mounted on a pair of shafts arranged parallel to each other so as to rotate in the opposite directions to each other, wherein each of the cutter units is provided with a holder member which includes a flange portion and a boss portion, and a disc-shaped cutter blade secured detachably to the holder member and divided circumferentially into several segments, the cutter units on the respective shafts being so arranged that the disc-shaped cutter blades of every paired cutter units contact each other partly at their sides and that the disc-shaped cutter blade and flange portion of a cutter unit on one shaft are opposed to the boss portion of the mating cutter unit on the other shaft such that a space is formed between the peripheries of both cutter units; and each flange portion is provided with pawls along its outer periphery while each boss portion has provided along its periphery alternate ridges and recesses so designed as to maintain a substantially constant spacing between the outer periphery of the boss portion and the opposing periphery of the flange portion of the mating cutter unit during rotation of the cutter units.

2 Claims, 6 Drawing Figures

CRUSHER APPARATUS

BACKGROUND OF THE INVENTION

1. Field of the Invention

This invention relates to a crusher comprising a series of cutter units mounted on a pair of shafts arranged parallel to each other so as to rotate in the opposite directions to each other.

2. Description of the Prior Art

In the conventional solid waste crushers, as diagrammatically illustrated in FIG. 1, a pair of parallel shafts 13, 13' arranged to rotate in the opposite directions to each other are provided in a casing 12 having a hopper-like feed port 11, and cutter blades 14, 14' are mounted on the respective shafts such that said cutter blades 14, 14' contact each other partly at their sides so as to perform crushing of the waste material by shearing force.

In order to facilitate biting of the material to be crushed, each of the cutter blades 14, 14' is provided with radially extending protuberant portions 15, 15' along its outer periphery. These protuberant appendices, however, complicate the configuration of the cutter units and also could vary the shearing angle at which every associated cutter blades meet each other to make the horsepower requirement per unit time unstable during rotation, resulting in increased energy consumption and reduced power.

Further, in this type of crusher, there are usually used disc-shaped members with a radius which is the same as the filler blocks between the cutter blades on each shaft, so that if a break-down degree adjusting screen is provided beneath these members, such screen would soon become clogged and thus invite a reduction of discharging performance and an added difficulty in recycling the insufficiently worked material back to the cutting system, resulting in an excessively lowered disposal capacity. Moreover, the insufficiently crushed material would stagnate below the cutter blades to act as a brake against the rotating elements, causing wasteful consumption of power and abnormal evolution of heat. Another serious disadvantage of conventional crushers is that it is necessary to disassemble the main shaft for replacing worn-out cutter blades. Such disassembling and re-assembling of the shaft is very troublesome and time-consuming.

SUMMARY OF THE INVENTION

The first object of this invention is to provide a crusher with excellent crushing efficiency.

The second object of this invention is to provide a crusher which is low in energy consumption and high in power.

The third object of this invention is to provide a crusher which is compact in construction and easy to assemble and disassemble.

The fourth object of this invention is to provide a crusher which causes no jamming of the material to be treated into the working mechanism and is high in treated material discharging performance.

In order to accomplish the aforementioned objects, there is provided in one embodiment of the present invention a crusher comprising a series of cutter units mounted on a pair of parallel shafts arranged to rotate in the opposite directions to each other, characterized such that each cutter unit includes a holder member consisting of a flange portion and a boss portion, and a disc-shaped cutter blade mounted detachably to the holder member and divided circumferentially into several segments, the cutter units on both shafts being so arranged that their respective cutter blades contact each other partly at their sides and that the cutter blade and flange portion of a cutter unit on one shaft are opposed to the boss portion of the corresponding cutter unit on the other shaft such that a space is formed between the outer peripheries of the opposing cutter units, and each said flange portion is provided with protuberant pawls along its outer periphery while each boss portion is provided along its outer periphery with alternate ridges and recesses so designed as to maintain substantially the same spacing between the outer periphery of the boss portion of a cutter unit on one shaft and the outer periphery of the flange portion of the opposing cutter unit on the other shaft.

According to another embodiment of the present invention, there is provided a crusher which is substantially identical in construction as that of the described first embodiment but in which the cutter units are arranged on said respective shafts with a certain phase lag relative to each other circumferentially of the shafts.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
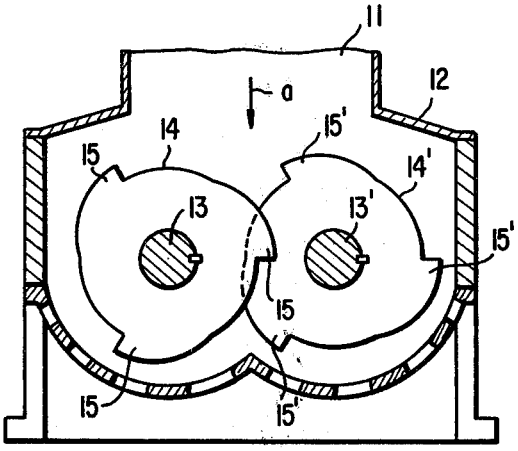
FIG. 1 PRIOR ART
FIG. 1 is a horizontal sectional view of a conventional device.
Figure 2:
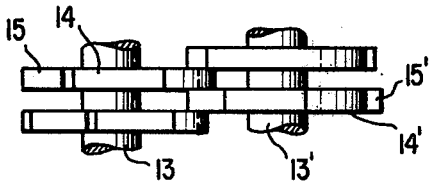
FIG. 2 PRIOR ART
FIG. 2 is a view of the cutter units in the device of FIG. 1 as taken in the direction of arrow a in FIG. 1.
Figure 3:
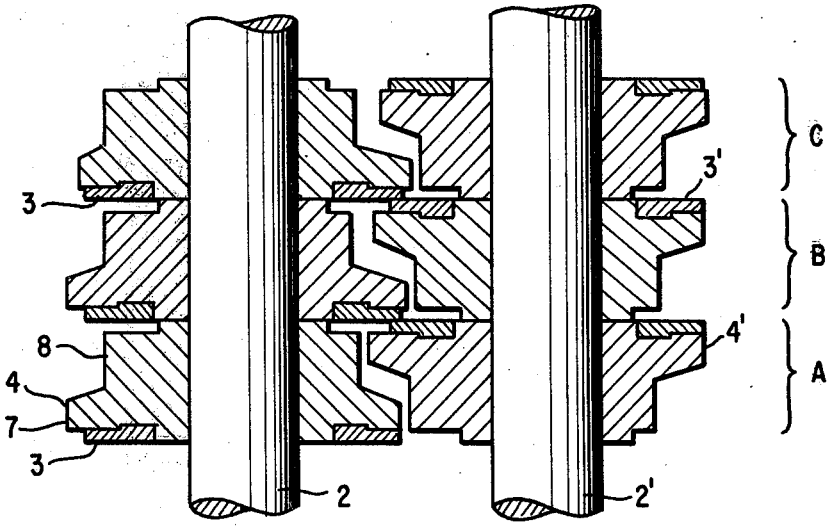
FIG. 3 is a fragmental horizontal sectional view of one embodiment of the present invention.
Figure 4:
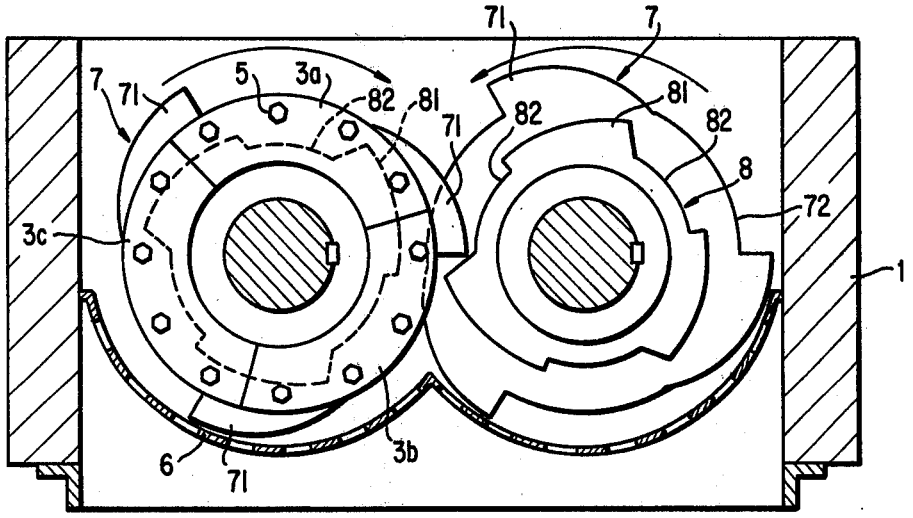
FIG. 4 is a vertical sectional view of the embodiment shown in FIG. 3.

The invention will now described in detail by way of an embodiment thereof with particular reference to FIGS. 3 and 4 of the accompanying drawings.

It will be seen that a pair of shafts 2, 2' are arranged parallel to each other in a casing 1, both shafts 2, 2' having mounted at their ends synchronous gears (not shown) whereby the shafts are rotated in opposite directions to one another, with a series of cutter units A,B,C, ... being mounted on each of the shafts so as to be provided with a certain phase difference from each other circumferentially of the shaft. Each of the cutter units includes a holder member 4, 4' (hereinafter referred to as 4) composed of a flange portion 7 and a boss portion 8 as well as a disc-shaped cutter blade 3, 3' (hereinafter referred to as 3) secured to the holder member 4.

The cutter blade 3 is divided circumferentially into several segments (three segments **3*a*, 3*b* and 3*c* being shown in this embodiment) each of which is detachably fixed to the holder member 4 by means of bolts 5. The flange portion 7 has on its front side a face vertical to the shaft and a stepped portion for mounting the cutter blade 3 while the rear side of the flange portion is tapered to terminate into integral boss portion 8 of cutter blade 3**.

Flange portion 7 is also provided with a suitable number of protuberant pawls 71 (three pawls being shown in this embodiment) and recesses 72 along its outer periphery. Each of the pawls 71 has a sharp radially extending edge at its foremost end in the direction of rotation and is gradually reduced in height as the distance from the sharp edge increases rearwardly (that is, oppositely to the direction of rotation) until the periphery of pawl portion 71 terminates into the normal periphery of the flange portion 7. The boss portion 8 of cutter blade has ridges 81 and recesses 82 formed alternately along its outer periphery as shown by solid line on the right-hand side of FIG. 4 and by the broken line on the left-hand side thereof Each of the ridges 81 has at its foremost end (in the direction of rotation) an end face extending radially of the shaft and is gradually increased in height rearwardly in the direction of rotation, with the rearmost end presenting a slant face joining into the succeeding recess 82. These cutter units A, B, C,.... are arranged such that the cutter blade and flange portion of one cutter unit are opposed to the boss portion of the opposing cutter unit and that the cutter blades of every two opposing cutter units contact each other partly at their sides.

According to this construction, the material to be crushed supplied from the hopper is cut by the cutter blades 3, 3' rotating in opposite directions to one another. It is to be noted here that since the cutter blades are circular in shape, the angle of shearing against the material to be crushed always stays constant and hence, the shearing length per unit time is also kept constant to allow maintenance of a stabilized power requirement.

Figure 5A:
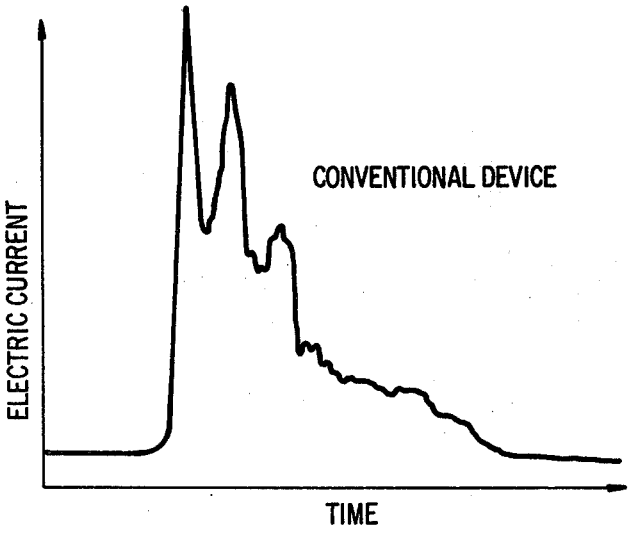
FIGS. 5A and B are graphic comparisons of power requirements in a conventional device and in the device of the present invention, respectively.
Figure 5B:
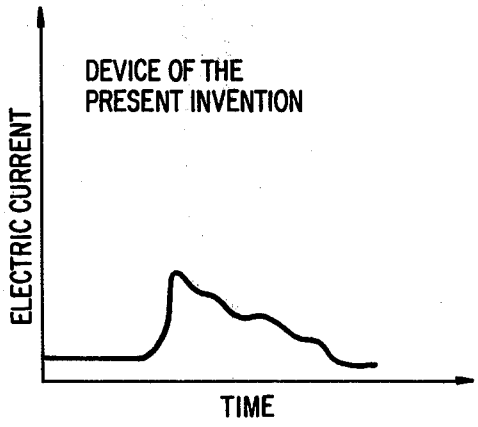

FIG. 5 is a graphic comparison of the power requirement for a given output in case of crushing waste rubber by using the device of this invention versus a conventional device. As noticed from the graphs, excessively high power is required in the conventional device due to impulsive load caused by the change of shearing angle upon engagement of the protuberances of the cutter blades whereas in the device of this invention, no such impulsive load is given, allowing sizable reduction of the power requirement and shortening of the treating time.

In the device of this invention, the flange portion of one cutter unit and the boss portion of the adjoining cutter unit are opposed to each other so as to provide therebetween a space for delivering the crushed material, and also the crushed material is forced out by the joint operation of the pawls 71 of each flange portion and the ridges 81 of the associated boss portion so that the crushed material carried beneath the cutter units is subjected to a positive pressing force and urged to discharge out through a screen 6. The pieces of material not sufficiently crushed, which are unable to pass through the screen 6, are not stagnated but are forced to move in the direction of rotation and scooped up to the tops of the respective cutter units by the pawls 71 and the foremost end faces of the ridges 81 to let the pieces of material undergo another cycle of crushing treatment.

Further, every opposing boss and flange portion are so designed as to always maintain a substantially identical space between their outer peripheries, and arrangement is also made such that each pawl 71 is opposed to a recess 82 in the associated boss portion and each ridge 81 is opposed to the flat portion (where no pawl is formed) of the associated flange portion so as to produce a difference in peripheral speed between their respective rotating outer peripheral faces, so that the crushed material that passed therebetween receives a frictional force owing to such difference in peripheral speed, urging natural detachment and discharge of the crushed material caught between or twined around the cutter units, thus greatly improving the discharging performance of the device.

Moreover, since the cutter blades are detachably mounted to the holder by bolts, any cutterblade with worn-out cutting edges can be easily replaced with no need of disassembling the main shaft as necessitated in conventional devices, resulting in a sizable reduction of cost for replacement. The cutter blades used in this invention are also easy to grind and reuse as they are small-sized.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A crusher which comprises a plurality of paired cutter units mounted respectively on a pair of parallel shafts arranged to rotate in opposite directions to one another, wherein:

each of said paired cutter units comprises a holder member consisting of a flange portion and a boss portion, and a disc-shaped cutter blade detachably secured to said holder member and divided circumferentially into several segments;

each of said paired cutter units includes a first and second cutter unit mounted on the respective shafts such that respective cutter blades of said first and second cutter unit contact each other partly at their sides, and that the respective cutter blade and flange portion of said first and second cutter unit are opposed to the boss portion of cutter units mounted on said respective shafts adjacent said first and second cutter unit so as to form a space between their respective peripheries; and wherein each of said flange portions is provided with pawls along its outer periphery while each of said boss portions is also provided along its outer periphery with alternate ridges and recesses so as to maintain a substantially constant space between the periphery of the boss portion of each of said first and second cutter units and the corresponding periphery of the flange portion of each of said cutter units mounted on said respective shafts adjacent said first and second cutter unit.

2. A crusher as set forth in claim 1, wherein said paired cutter units are provided on said respective shafts with a certain phase lag relative to each other circumferentially of said shafts.

* * * * *